US011057715B2

(12) United States Patent
Duan et al.

(10) Patent No.: US 11,057,715 B2
(45) Date of Patent: Jul. 6, 2021

(54) PIEZOELECTRIC MICROPHONE

(71) Applicant: AAC Acoustic Technologies (Shenzhen) Co., Ltd., Shenzhen (CN)

(72) Inventors: Lian Duan, Shenzhen (CN); Rui Zhang, Shenzhen (CN)

(73) Assignee: AAC ACOUSTIC TECHNOLOGIES (SHENZHEN) CO., LTD., Shenzhen (CN)

( * ) Notice: Subject to any disclaimer, the term of this patent is extended or adjusted under 35 U.S.C. 154(b) by 0 days.

(21) Appl. No.: 16/702,596

(22) Filed: Dec. 4, 2019

(65) Prior Publication Data

US 2020/0213769 A1 Jul. 2, 2020

(30) Foreign Application Priority Data

Dec. 31, 2018 (CN) ..... 201811650376.1

(51) Int. Cl.
*H04R 17/02* (2006.01)
*H04R 7/04* (2006.01)
*H04R 7/16* (2006.01)

(52) U.S. Cl.
CPC ..... *H04R 17/02* (2013.01); *H04R 7/04* (2013.01); *H04R 7/16* (2013.01)

(58) Field of Classification Search
CPC ..... H04R 17/02; H04R 7/04; H04R 7/16
USPC ..... 381/173
See application file for complete search history.

(56) References Cited

U.S. PATENT DOCUMENTS

2018/0002167 A1* 1/2018 Frischmuth ..... G01Q 60/24

FOREIGN PATENT DOCUMENTS

CN 102158788 A1 8/2011

OTHER PUBLICATIONS

PCT search report dated Jan. 15, 2020 by SIPO in related PCT Patent Application No. PCT/CN2019/113284 (4 Pages).

* cited by examiner

*Primary Examiner* — Sean H Nguyen
(74) *Attorney, Agent, or Firm* — W&G Law Group LLP

(57) ABSTRACT

The present application provides a piezoelectric microphone including a substrate having a back cavity and a piezoelectric cantilever diaphragm fixed to the substrate, the piezoelectric cantilever diaphragm includes a fixed end fixedly connected to the substrate and a movable end connected to the fixed end and suspended above the back cavity, the piezoelectric microphone further includes a support back plate, the support back plate includes a support arm opposite to and spaced apart from the movable end of the piezoelectric cantilever diaphragm and a fixing arm that fixes the support arm. The piezoelectric microphone of the present disclosure has better stability compared to the related art.

9 Claims, 5 Drawing Sheets

A–A

PIEZOELECTRIC MICROPHONE

TECHNICAL FIELD

The present disclosure relates to the field of electroacoustic conversion, and more particularly, to a piezoelectric microphone.

BACKGROUND

MEMS microphones are now widely used and popularized in consumer electronic products. A conventional MEMS microphone is mainly a condenser microphone, and it includes a substrate, and a back plate and a diaphragm that are formed on the substrate. The diaphragm and the back plate form a capacitor system. Vibration of sound waves will drive the diaphragm of the microphone to vibrate back and forth, and in turn change a distance between the diaphragm and the back plate and a value of a plate capacitance. By detecting a change in the capacitance, a sound signal can be converted into an electrical signal. When the mobile device is in a dusty environment, particles in air easily enter and get caught between the diaphragm and the back plate of the microphone, such that the diaphragm cannot move; and when the mobile device is in a humid environment, it is easy for water droplets to condense between the diaphragm and the back plate of the microphone, so that the diaphragm and the back plate are adhered by the water droplets. Both of the above conditions can cause the microphone to fail. In order to avoid such problems, piezoelectric MEMS microphones have emerged.

A fabrication process of the piezoelectric microphones is simple, and a design framework employing a single-layer membrane makes it unrestricted by air damping, such that an SNR is naturally improved. In addition, the piezoelectric microphone only includes the diaphragm, and does not include the back plate, which fundamentally eliminates harm caused by the particles and water vapor in the air to the microphone, thereby greatly improving reliability of the microphone.

A diaphragm flap of the diaphragm of many piezoelectric microphone in the related art has one end fixed and one end being a free cantilever structure. When an external sound signal is introduced from a sound hole, a sound pressure causes the cantilever to deform, to generate a voltage change, thereby sensing an acoustic signal.

However, the piezoelectric microphone in the related art is not provided with a support structure. Thus, when the cantilever structure has a relatively large deformation due to the piezoelectric microphone being subjected to a relatively large sound pressure, since a material of the diaphragm is relatively fragile, the cantilever often breaks from a position where stress concentrates, which greatly affects the stability of the piezoelectric microphone.

Therefore, it is necessary to provide an improved piezoelectric microphone to solve the above problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will be further illustrated with reference to the accompanying drawings and the embodiments.

Embodiment 1

Figure 1:
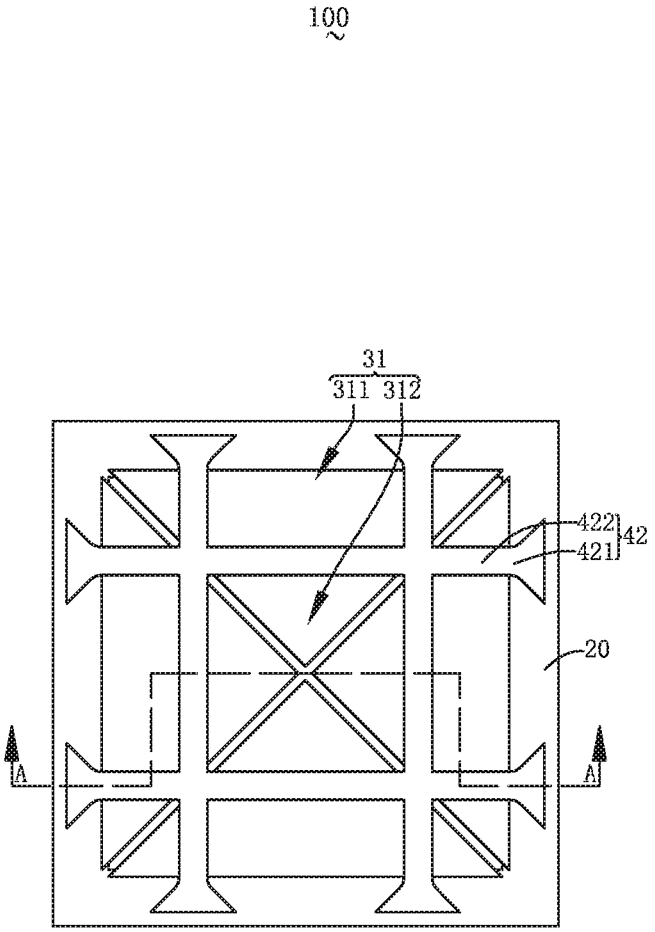
FIG. 1 is a structural schematic diagram of Embodiment 1 of a piezoelectric microphone according to the present disclosure.
Figure 2:
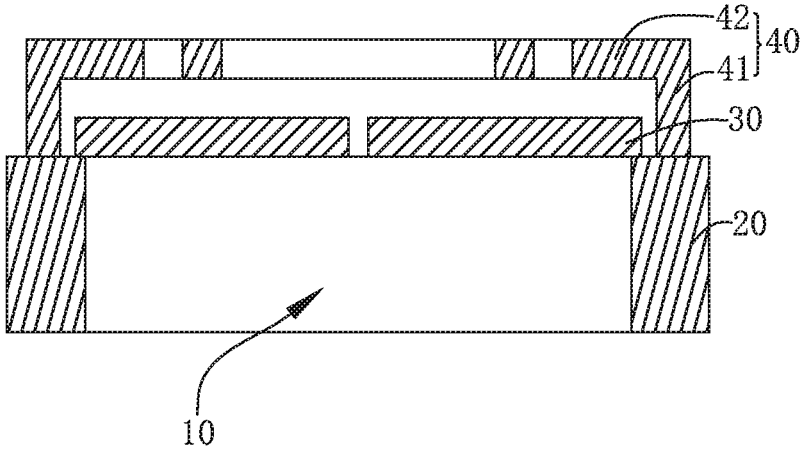
FIG. 2 is a cross-sectional diagram taken along line A-A of FIG. 1.

Referring to FIG. 1 and FIG. 2, the present disclosure provides a piezoelectric microphone 100, and it includes a substrate 20 having a back cavity 10, a piezoelectric cantilever diaphragm 30 fixed to the substrate 20 and a support back plate 40 fixed to the substrate 20.

The piezoelectric cantilever diaphragm 30 is composed of four diaphragm flaps 31 of the same size, and every two adjacent diaphragm flaps 31 are spaced apart from each other. In the present embodiment, each of the four diaphragm flaps 31 is structured like a triangle, and the four diaphragm flaps 31 define the piezoelectric cantilever diaphragm 30 having a rectangular structure.

It should be noted that, in this embodiment, four diaphragm flaps 31 are provided and are all triangular structures, and they define the piezoelectric cantilever diaphragm 30 having a rectangular structure. Without doubt, in other embodiments, the number of the diaphragm flaps 31 can be any desired number, and the structures of the diaphragm flaps 31 can also be of any shape. Moreover, the structure of the piezoelectric cantilever diaphragm 30 defined by the diaphragm flaps 31 can also be of any shape. In the present embodiment, the case in which a rectangular piezoelectric cantilever diaphragm 30 is defined by only four triangular diaphragm flaps 31 is described as an example.

The diaphragm flap 31 includes a fixed end 311 fixedly connected to the substrate 20 and a movable end 312 connected to the fixed end 311 and suspended above the back cavity 10.

The support back plate 40 includes a fixing arm 41 fixedly connected to the substrate 20 and a support arm 42 connected to the fixing arm 41. The support arm 42 of the support back plate 40 is of a hollow annular structure. The support arm 42 is located on a side of the piezoelectric cantilever diaphragm 30 facing away from the back cavity 10, and the support arm 42 is spaced apart from and opposite to the movable end 312 of the piezoelectric cantilever diaphragm 30. The support arm 42 is configured to provide a certain support protection to the piezoelectric cantilever diaphragm 30 when the piezoelectric cantilever diaphragm 30 has a relatively large deformation, thereby preventing the piezoelectric cantilever diaphragm 30 from being broken.

An extending direction of the fixing arm 41 is perpendicular to an extending direction of the support arm 42.

It should be noted that in this embodiment, the fixing arm 41 is fixed on the substrate 20. Without doubt, in other embodiments, the fixing arm 41 can be fixed to an edge of the piezoelectric cantilever diaphragm 30, i.e., fixed to the fixed end 311. That is, the support back plate 40 can be fixed at any position, as long as the support back plate 40 can achieve a protection effect on the piezoelectric cantilever diaphragm 30.

The support arm 42 includes a connecting end 421 connected to the fixing arm 41 and a support end 422 connected to an end of the connecting end 421 facing away from the fixing arm 41. A plurality of support ends 422 crisscross to form a mesh structure.

In this embodiment, the four support ends 422 crisscross to together form a structure like a Chinese character "井".

It should be noted that, in this embodiment, the support ends 422 crisscross to together form a structure like a Chinese character "井". Without doubt, in other embodiments, the number of the support ends 422 can be arbitrary, and the plurality of support ends 422 can also constitute into any structure. That is, in the present disclosure, the number and arrangement of the support ends 422 are not limited, as long as the support back plate 40 can achieve the protection effect on the piezoelectric cantilever diaphragm 30.

Embodiment 2

Figure 3:
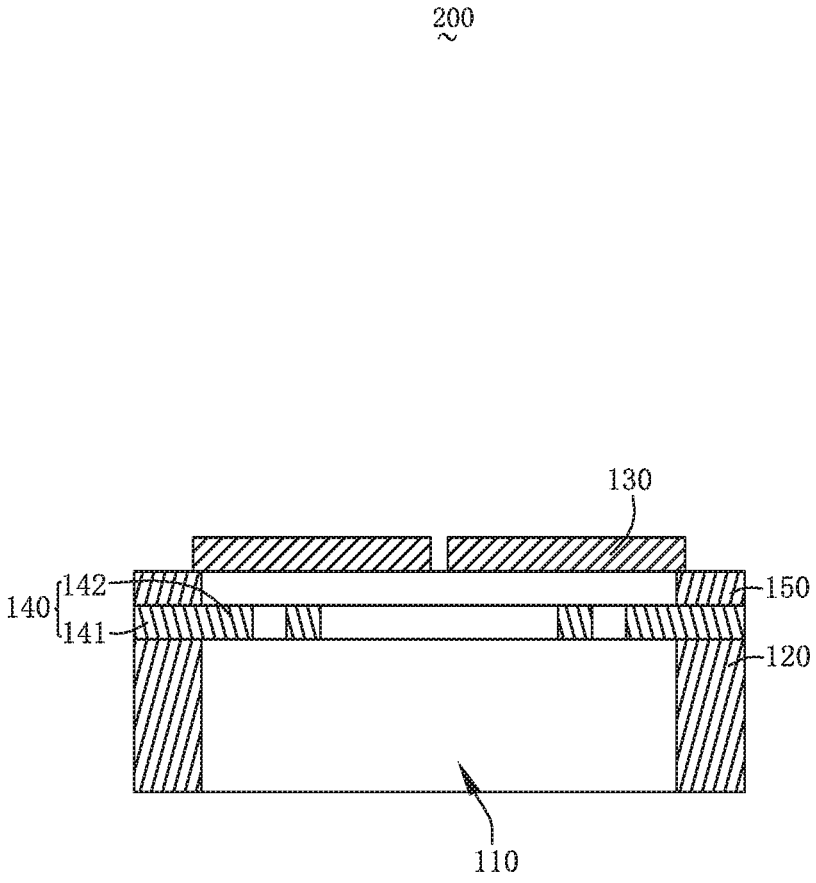
FIG. 3 is a cross-sectional diagram of Embodiment 2 of a piezoelectric microphone according to the present disclosure.

Referring to FIG. 3, an embodiment provides a piezoelectric microphone 200, and it includes a substrate 120 having a back cavity 110, a piezoelectric cantilever diaphragm 130, a support back plate 140, and a spacer layer 150. The spacer layer 150 is provided between the support back plate 140 and a fixed end of the piezoelectric cantilever diaphragm 130, so that a movable end of the piezoelectric cantilever diaphragm 130 is spaced apart from a support arm of the support back plate 140.

A structure of the piezoelectric cantilever diaphragm 130 is substantially the same as that of the piezoelectric cantilever diaphragm 30 in Embodiment 1.

The support back plate 140 includes a fixing arm 141 fixed to the substrate 120 and a support arm 142 connected to the fixing arm 141. The support arm 142 is opposite to and spaced apart from the piezoelectric cantilever diaphragm 130. The support arm 142 is configured to provide a certain support protection to the piezoelectric cantilever diaphragm 130 when the piezoelectric cantilever diaphragm 130 has a relatively large deformation, thereby preventing the piezoelectric cantilever diaphragm 130 from being broken.

The fixing arm 141 is located between the substrate 120 and the spacer layer 150. The support arm 142 is located on a side of the piezoelectric cantilever diaphragm 130 close to the back cavity 110.

It should be noted that, in this embodiment, the support back plate 140 is fixedly connected to the substrate 120. In other embodiments, the support back plate 140 may be fixedly connected to the piezoelectric cantilever diaphragm 130. That is, in the present disclosure, the fixing manner of the support back plate 140 is not limited, as long as the support back plate 140 can achieve the protection effect on the piezoelectric cantilever diaphragm 130.

Embodiment 3

Figure 4:
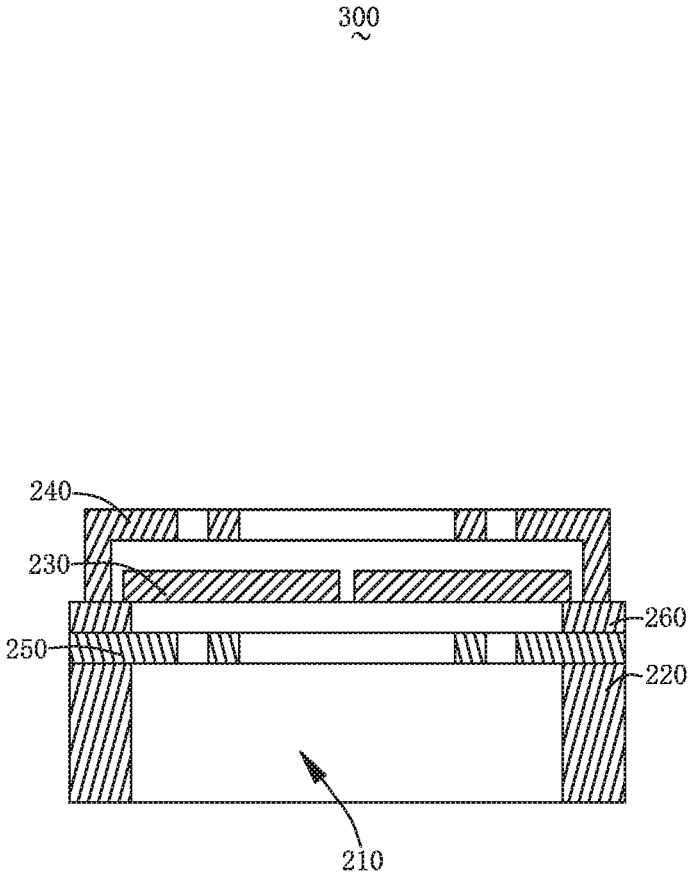
FIG. 4 is a cross-sectional diagram of Embodiment 3 of a piezoelectric microphone according to the present disclosure.

Referring to FIG. 4, an embodiment provides a piezoelectric microphone 300, and it includes a substrate 220 having a back cavity 210, a piezoelectric cantilever diaphragm 230, a first support back plate 240, a second support back plate 250, and a spacer layer 260. The first support back plate 240 is provided on a side of the piezoelectric cantilever diaphragm 230 facing away from the back cavity 210. The second support back plate 250 is provided on a side of the piezoelectric cantilever diaphragm 230 close to the back cavity 210. The spacer layer 260 is provided between the second support back plate 250 and a fixed end of the piezoelectric cantilever diaphragm 230.

The structures of the piezoelectric cantilever diaphragm 230 and the first support back plate 240 are substantially the same as the structures of the piezoelectric cantilever diaphragm 30 and the support back plate 40 in Embodiment 1. In this embodiment, the first support back plate 240 is fixed on the spacer layer 260.

The structure of the second support back plate 250 is the same as that of the support back plate 140 in Embodiment 2.

It should be noted that, in this embodiment, the first support back plate 240 and the second support back plate 250 are both fixedly connected to the spacer layer 260. In other embodiments, the first support back plate 240 and the second support back plate 250 may be fixedly connected to the piezoelectric cantilever diaphragm 230. That is, in the present disclosure, the fixing manner of the first support back plate 240 and the second support back plate 250 is not limited, as long as the first support back plate 240 and the second support back plate 250 can achieve the protection effect on the piezoelectric cantilever diaphragm 230.

Embodiment 4

Figure 5:
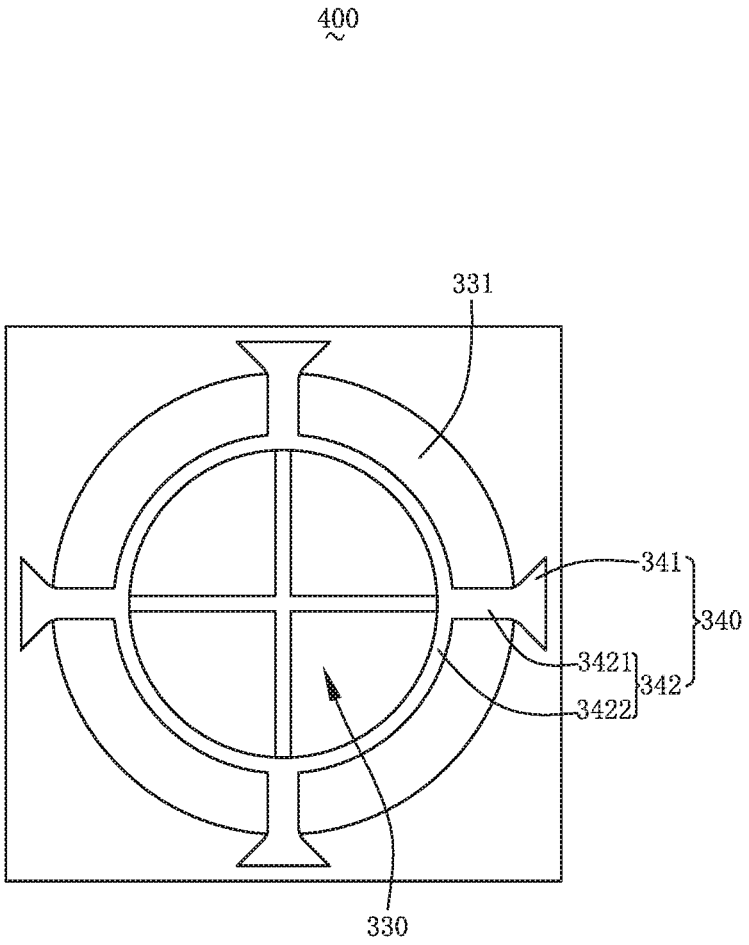
FIG. 5 is a structural schematic diagram of Embodiment 4 of a piezoelectric microphone according to the present disclosure.

Referring to FIG. 5, an embodiment provides a piezoelectric microphone 400. The structure of the piezoelectric microphone 400 is basically the same as that of the piezoelectric microphone 100 described in Embodiment 1, and a difference lies in:

In the present embodiment, the piezoelectric cantilever diaphragm 330 is composed of four diaphragm flaps 331 having a sector-shaped structure. The four diaphragm flaps 331 define the piezoelectric cantilever diaphragm 330 having a circular structure. Every two adjacent diaphragm flaps 331 are spaced apart from each other.

The support back plate 340 includes a fixing arm 341 fixed to the substrate 320 and a support arm 342 connected to the fixing arm 341.

The support arm 342 includes a connecting end 3421 connected to the fixing arm 341 and a support end 3422 connected to one end of the connecting end 3421 facing away from the fixing arm 341. An orthographic projection of the support end 3422 towards the piezoelectric cantilever diaphragm 330 completely falls into a region enclosed by the four diaphragm flaps 331.

The support end 3422 is annular, and a center of a circle of the support end 3422 is located on the same straight line as a center of a circle of the piezoelectric cantilever diaphragm 330. Four connecting ends 3421 are provided, and orthographic projections of the four connecting ends 3421 towards the piezoelectric cantilever diaphragm 330 are respectively located at gaps between the four diaphragm flaps 331.

Compared with the related art, the piezoelectric microphone of the present disclosure is provided with the support back plate, such that the support back plate can provide a certain support protection to the piezoelectric cantilever diaphragm when the piezoelectric cantilever diaphragm has a relatively large deformation under a relatively large sound pressure, thereby preventing the piezoelectric cantilever diaphragm from being broken, and thus increasing the stability of the piezoelectric microphone.

What has been described above are merely embodiments of the present disclosure, and it should be noted herein that one ordinary person skilled in the art can make improvements without departing from the inventive concept of the present disclosure, but these are all within the scope of the present disclosure.

What is claimed is:

1. A piezoelectric microphone, comprising:

a substrate having a back cavity;

a piezoelectric cantilever diaphragm fixed to the substrate, the piezoelectric cantilever diaphragm comprising a fixed end fixedly connected to the substrate and a movable end connected to the fixed end and suspended above the back cavity; and one or more support back plates, each of the one or more support back plates comprising a support arm opposite to and spaced apart from the movable end of the piezoelectric cantilever diaphragm and a fixing arm that fixes the support arm, the piezoelectric cantilever diaphragm comprising a plurality of diaphragm flaps of a same size, every two adjacent diaphragm flaps of the plurality of diaphragm flaps spaced apart from each other, and each of the plurality of diaphragm flaps comprising the fixed end fixedly connected to the substrate and the movable end opposite to the fixed end.

2. The piezoelectric microphone as described in claim 1, wherein the support arm is provided on a side of the piezoelectric cantilever diaphragm facing away from the back cavity.

3. The piezoelectric microphone as described in claim 2, wherein the fixing arm is fixed to the substrate or the fixed end of the piezoelectric cantilever diaphragm.

4. The piezoelectric microphone as described in claim 2, wherein an extending direction of the fixing arm is perpendicular to an extending direction of the support arm.

5. The piezoelectric microphone as described in claim 1, wherein the support arm is provided on a side of the piezoelectric cantilever diaphragm close to the back cavity, and the piezoelectric microphone further comprises a spacer layer provided between the support back plate and the fixed end of the piezoelectric cantilever diaphragm in such a manner that the movable end of the piezoelectric cantilever diaphragm is spaced apart from the support arm of the support back plate.

6. The piezoelectric microphone as described in claim 1, wherein the one or more support back plates comprise a first support back plate provided on a side of the piezoelectric cantilever diaphragm facing away from the back cavity, and a second support back plate provided on a side of the piezoelectric cantilever diaphragm close to the back cavity, and the piezoelectric microphone further comprises a spacer layer provided between the second support back plate and the fixed end of the piezoelectric cantilever diaphragm.

7. The piezoelectric microphone as described in claim 1, wherein the plurality of diaphragm flaps comprises four diaphragm flaps, each of the four diaphragm flaps is of a triangular structure, and the four diaphragm flaps define the piezoelectric cantilever diaphragm having a rectangular structure.

8. The piezoelectric microphone as described in claim 1, wherein the plurality of diaphragm flaps comprises four diaphragm flaps, each of the four diaphragm flaps is of a sector-shaped structure, and the four diaphragm flaps define the piezoelectric cantilever diaphragm having a circular structure.

9. The piezoelectric microphone as described in claim 1, wherein the support arm is of a hollow annular structure.

* * * * *